US009346313B2

(12) United States Patent
Takayama et al.

(10) Patent No.: US 9,346,313 B2
(45) Date of Patent: May 24, 2016

(54) BALLPOINT PEN TIP AND BALLPOINT PEN USING THE SAME

(75) Inventors: Kouichi Takayama, Hiratsuka (JP); Takumi Kajiwara, Hiratsuka (JP)

(73) Assignee: KABUSHIKI KAISHA PILOT CORPORATION (JP)

( * ) Notice: Subject to any disclaimer, the term of this patent is extended or adjusted under 35 U.S.C. 154(b) by 283 days.

(21) Appl. No.: 13/976,870

(22) PCT Filed: Dec. 27, 2011

(86) PCT No.: PCT/JP2011/080267

§ 371 (c)(1),
(2), (4) Date: Aug. 1, 2013

(87) PCT Pub. No.: WO2012/091036

PCT Pub. Date: Jul. 5, 2012

(65) Prior Publication Data

US 2014/0147190 A1 May 29, 2014

(30) Foreign Application Priority Data

Dec. 27, 2010 (JP) ..... 2010-289438
Aug. 23, 2011 (JP) ..... 2011-181607

(51) Int. Cl.
*B43K 7/00* (2006.01)
*B43K 1/08* (2006.01)
(Continued)

(52) U.S. Cl.
CPC ..... *B43K 1/084* (2013.01); *B43K 1/082* (2013.01); *B43K 7/00* (2013.01)

(58) Field of Classification Search
CPC ..... B43K 1/084; B43K 1/08; B43K 1/082; B43K 1/086
USPC ..... 401/208, 209, 216, 213–215
See application file for complete search history.

(56) References Cited

U.S. PATENT DOCUMENTS 3,678,565 A 7/1972 Linz et al.
6,082,920 A 7/2000 Furukawa
(Continued)

FOREIGN PATENT DOCUMENTS

DE 2210246 A1 9/1973
EP 1630214 A1 3/2006
(Continued)

OTHER PUBLICATIONS

International Search Report for International Application No. PCT/JP2011/080267, mailing date Mar. 27, 2012, 2 pages.
(Continued)

*Primary Examiner* — Mark A Laurenzi
*Assistant Examiner* — Thomas M Abebe
(74) *Attorney, Agent, or Firm* — Perkins Coie LLC

(57) ABSTRACT

A ballpoint pen tip is provided in which a curved contact surface, which has a curvature different from a curvature of the ball, is provided on the bottom wall of the ball holding chamber, and the ball is in contact with a contact part which is a part of the contact surface; and between the ball and the contact surface, a first gap is formed to extend from a side of the ink circulation hole up to the contact part such that the first gap gradually narrows from the side of the ink circulation hole, and a second gap is formed to extend from a distal side of an ink circulation groove up to the contact part such that the second gap gradually narrows from the distal side of the ink circulation groove.

10 Claims, 8 Drawing Sheets

(51) Int. Cl.
*B43K 7/10* (2006.01)
*B43K 23/08* (2006.01)

(56) References Cited

U.S. PATENT DOCUMENTS

| | | | | |
|---|---|---|---|---|
| 6,305,865 | B1 * | 10/2001 | Yoshii et al. | 401/219 |
| 6,332,728 | B1 * | 12/2001 | Ito et al. | 401/215 |
| 6,478,498 | B1 * | 11/2002 | Miyasaka et al. | 401/215 |

FOREIGN PATENT DOCUMENTS

| | | | | | |
|---|---|---|---|---|---|
| JP | 10-236054 | | | 9/1998 | |
| JP | 10236054 | | | 9/1998 | |
| JP | 2000-071672 | | | 3/2000 | |
| JP | 2001-039077 | | | 2/2001 | |
| JP | 2004-009605 | | | 1/2004 | |
| JP | 2004009605 | A | | 1/2004 | |
| JP | 2004-042434 | | | 2/2004 | |
| JP | 2004042434 | A | | 2/2004 | |
| JP | 2004042434 | A | * | 2/2004 | |
| JP | 2004-338134 | | | 12/2004 | |
| JP | 200442434 | A | * | 12/2004 | ..... B43K 1/08 |
| JP | 2004338134 | A | | 12/2004 | |
| JP | 2009-286107 | | | 8/2008 | |
| JP | 2009286107 | A | | 12/2009 | |
| JP | 2010-240931 | | | 10/2010 | |
| JP | 2010240931 | A | | 10/2010 | |
| WO | WO-9808693 | A1 | | 3/1998 | |

OTHER PUBLICATIONS

Supplementary European Search Report for European Application No. EP11852860, mailing date Apr. 17, 2014, 7 pages.

* cited by examiner

BALLPOINT PEN TIP AND BALLPOINT PEN USING THE SAME

This application is a 371 of PCT/JP2011/080267 filed Dec. 27, 2011, which claims priority to Japanese Patent Application Nos. 2010-289438 filed Dec. 27, 2010 and 2011-181607 filed Aug. 23, 2011. The entire contents of the above-identified applications are hereby incorporated by reference.

FIELD OF THE INVENTION

The present invention relates to a ballpoint pen tip in which a tip end portion of a tip body, which includes a ball holding chamber configured to hold a ball, an ink circulation hole formed in a center of a bottom wall of the ball holding chamber and a plurality of ink circulation grooves extending radially from the ink circulation hole, is caulked inside, so that a part of the ball held in the ball holding chamber projects from a tip end edge and the ball is rotatably held.

BACKGROUND ART

A ballpoint pen tip has been conventionally known, in which a tip end portion of a tip body, which includes a ball holding chamber configured to hold a ball, an ink circulation hole formed in a center of a bottom wall of the ball holding chamber and a plurality of ink circulation grooves extending radially from the ink circulation hole, is caulked inside, so that a part of the ball held in the ball holding chamber projects from a tip end edge and the ball is rotatably held.

In addition, like a "ballpoint pen tip" disclosed in JP2000-71672A, a lot of ballpoint pen tips have been proposed, in which a ball seat having the same contour as that of a ball is provided on a bottom wall of a ball holding chamber, and a ball is placed on the ball seat.

In addition, JP2001-39077A discloses that, by means of a hammering process that presses a ball for forming a ball seat from the side of a tip end portion, an inside portion of the ball seat rises up due to a spring-back property of a tip metal material, so that a counterbored part, by which an outside portion of the ball seat is not in contact with the ball, can be formed.

SUMMARY OF THE INVENTION

In the method of manufacturing a ballpoint pen tip disclosed in JP2000-71672A, since the ball seat is merely formed, wear of the ball seat cannot be restrained.

On the other hand, in the method of manufacturing a ballpoint pen tip disclosed in JP2001-39077A, since an additional process for forming the counterbored part is needed, a manufacturing cost increases. In addition, although the method improves an ink circulation up to the ball seat, the method does not adjust an ink flow at the ball seat. Thus, wear of the ball seat is difficult to be restrained.

According to the study by the present inventors as to a relationship between a rotating ball and a ball seat, there are lubrication conditions, i.e., a fluid lubrication condition which is formed by an ink for ballpoint pen entering between the ball and the ball seat, a boundary lubrication condition in which the ball and a contact surface of the ball seat are in direct contact with each other, and a mixed lubrication condition in which the fluid lubrication condition and the boundary lubrication condition are mixed with each other.

Inks to be used in ballpoint pens can be broadly classified into a water-based ink for a ballpoint pen, a water-based or oil-based ink for a ballpoint pen to which a shear-rate thinning property has been imparted, and an oil-based ink for a ballpoint pen. Recently, in order to enhance a feel of the ballpoint pen when writing or the like, the water-based or oil-based ink for a ballpoint pen to which a shear-rate thinning property has been imparted and the oil-based ink for a ballpoint pen are desired to have a lower viscosity. In this case, the boundary lubrication condition is likely to occur, and thus the ball and the ball seat are easy to wear away.

The present invention has been made in view of the above problems, so as to effectively solve the same. The object of the present invention is to provide a ballpoint pen tip of a simple structure, which can provide a good feel of a ballpoint pen when writing and can restrain wear of a ball and a ball seat.

The present invention is a ballpoint pen tip in which a tip end portion of a tip body, which includes a ball holding chamber configured to hold a ball, an ink circulation hole formed in a center of a bottom wall of the ball holding chamber, and a plurality of ink circulation grooves extending radially from the ink circulation hole, is caulked inside, so that a part of the ball held in the ball holding chamber projects from a tip end edge and the ball is rotatably held, wherein: a curved contact surface, which has a curvature different from a curvature of the ball, is provided on the bottom wall of the ball holding chamber, and the ball is to be in contact with a contact part which is a part of the contact surface; and between the ball and the contact surface, a first gap is formed to extend from a side of the ink circulation hole up to the contact part such that the first gap gradually narrows from the side of the ink circulation hole, and a second gap is formed to extend from a distal side of an ink circulation groove up to the contact part such that the second gap gradually narrows from the distal side of the ink circulation groove.

According to the present invention, since there are formed the first gap that gradually narrows from the side of the ink circulation hole and the second gap that gradually narrows from the distal side of the ink circulation groove, it is easy to maintain a space between the ball and the contact surface (contact part) in the fluid lubrication condition or in the mixed lubrication condition. Thus, wear of the contact surface (contact part) can be restrained. Further, it was confirmed that the present invention is effective in making stable an ink outflow rate, in making smooth an ink return and in improving a feel of the ballpoint pen when writing. Such a ballpoint pen tip can be widely available in ballpoint pens. However, since wear of the contact surface can be restrained, this ballpoint pen tip is especially, suitably available in a ballpoint pen using a ball having a diameter as small as 0.5 mm or less.

The present inventors have analyzed the effect obtained by the formation of the first gap and the second gap as follows. Namely, along with the rotation of the ball 9 when writing, the ink for ballpoint pen is led from the ink circulation hole into the first gap, so that a layer of the ink for ballpoint pen is formed between the ball and the contact surface. A pressure is generated by the ink layer, so that a force that floats up the ball is generated (wedge effect). This restrains wear of the bottom wall. Suppose that the curvature of the ball and the curvature of the contact surface completely conform to each other so that there exists no first gap. In this case, since the ink is not led into the space between the ball and the contact surface, the wear restraining effect cannot be provided.

In addition, when writing, the ink for ballpoint pen that could not protrude onto the paper sheet is returned from the ball holding chamber to the contact surface. At this time, because of the formation of the second gap, another ink layer is also formed in the second gap. Thus, a feel of the ballpoint pen when writing and wear resistance can be improved by the synergy produced by the ink layer effect in the first gap and the ink layer effect in the second gap.

In order to form the aforementioned first gap and the second gap between the ball and the contact surface, it is important that the contact surface has a curved shape having a curvature different from the curvature of the ball.

In addition, the smaller an opening of the first gap on the side of the ink circulation hole is, the higher the wedge effect becomes. Thus, it is preferable that the opening on the side of the ink circulation hole is small. Specifically, when a length of the opening on the side of the ink circulation hole exceeds 10 μm in the shaft center direction, the wedge effect is difficult to be obtained. Thus, the length of the opening on the side of the ink circulation hole is preferably not more than 10 μm in the shaft center direction, more preferably from 0.001 μm to 5 μm, and most preferably from 0.001 μm to 1 μm.

In addition, since the first gap is formed to gradually narrow from the side of the ink circulation hole, the high wedge effect (force that floats up the ball) can be obtained in the vicinity of the contact part with the ball. Thus, wear of the contact surface (in particular, the contact part) can be effectively restrained.

Preferably, the contact part is located nearer to the tip end portion than a central position in a shaft center direction of the contact surface. In this case, it can be assured that a length of the first gap is larger than a length of the second gap, which ensures a high wear resistance. As compared with an amount of a ballpoint pen ink which is supplied from the ink circulation hole to the contact surface, an amount of the ballpoint pen ink which is returned from the ball holding chamber to the contact surface is smaller. Thus, the structure in which the length of the first gap is larger than the length of the second gap is advantageous in the wedge effect generation.

In addition, preferably, the contact surface is axisymmetric with respect to a shaft center, and the contact part is located annularly in a circumferential direction of the contact surface. In this case, since the first gap and the second gap are formed in a well-balanced manner, it is further easy to maintain the fluid lubrication condition or the mixed lubrication condition.

Alternatively, preferably, the contact part is located at substantially regular intervals in a circumferential direction of the contact surface. Also in this case, since the first gap and the second gap are formed in a well-balanced manner, it is further easy to maintain the fluid lubrication condition or the mixed lubrication condition. Moreover, in this case, the contact part is preferably located apart from the ink circulation grooves. In particular, the contact part is preferably located on a substantially intermediate position between the ink circulation grooves in the circumferential direction. In this case, even when the contact part wears away, the wear exerts less influence on the function of the ink circulation grooves. Thus, a stable ink flow can be continuously maintained.

In addition, the present invention is a ballpoint pen refill in which the ballpoint pen tip having the aforementioned features is mounted directly on an end of an ink storage tube or mounted thereon through a tip holder, the ink storage tube storing an ink for ballpoint pen, wherein the ink for ballpoint pen contains at least particles, and a size of the particles is smaller than a length of an opening on the side of the ink circulation hole in the shaft center direction.

According to the present invention, good handwriting and a good feel of the ballpoint pen when writing can be provided. The reason is considered to be that particles enter the first gap to promote lubricity, whereby the gap between the ball and the contact surface can be easily maintained. In addition, it can be considered that, since the particles exhibit a repulsive function like a cushion, the ink layer between the ball and the contact surface can be easily retained.

The aforementioned particles are not particularly limited, and pigments such as inorganic pigments, organic pigments or processed pigments, organic particles, inorganic particles and so on can be taken for instance. As to the pigment, a carbon black, a pearl pigment, a fluorescent pigment, a phosphorescent pigment, a complementary pigment, a microcapsule pigment and so on can be specifically taken for instance. As to the particle, a resin particle such as an acryl-based particle, a silicone-based particle or a polyethylene-based particle, an alumina particle, a silica particle and so on can be specifically taken for instance.

The size of the particle in the present invention means an average size. When particles are of a substantially spherical shape, the size means an average particle diameter. The size can be obtained by measurement of a centrifugal-sedimentation type or a laser-diffraction type. The size of the particle is smaller than the length of the opening of the first gap on the side of the ink circulation hole in the shaft center direction, and is from 0.001 μm to less than 10 μm, preferably from 0.001 μm to 5 μm. Most preferably, the shape of the particle is spherical or substantially spherical. In addition, the content of the particles is preferably from 0.1 to 15% by mass relative to the total ink composition.

In addition, the present invention is the ballpoint pen tip having the aforementioned features, wherein a face of the ball and/or a face of the contact surface is provided with a lubrication coating layer.

In this case, owing to the synergy produced by the lubrication coating layer and the fluid lubrication condition or the mixed lubrication condition provided by the above ink layer, a contact resistance between the ball and the contact surface or the tip inner wall can be significantly decreased, whereby wear resistance and a feel of the ballpoint pen when writing can be significantly enhanced.

As a material of the lubrication coating layer, a conventionally known solid lubricant such as diamond-like carbon (DLC), tungsten disulfide ($WS_2$), molybdenum disulfide ($MoS_2$), graphite, fluorine containing polymer such as tetrafluoroethylene (PTFE), silicone resin and so on can be suitably used. A method of coating the lubrication coating layer is not particularly limited, and a vacuum vapor deposition method, an ion vapor deposition method, a physical vapor deposition method, a chemical vapor deposition method, a vacuum arc vapor deposition and so on can be taken for instance. The face may not be coated directly with the lubrication coating layer but may be coated with a layer containing the aforementioned lubricants. In consideration of wear resistance and lubricity, the use of diamond-like carbon (DLC) among the aforementioned lubricants is most preferable.

A material of the ball is not particularly limited, and may be a carbide material such as tungsten carbide, a ceramic material such as zirconia, a stainless steel material and so on. A material of the tip body is also not particularly limited, and may be stainless steel, copper alloy, aluminum and so on.

BEST MODE FOR CARRYING OUT THE INVENTION

First Embodiment

Figure 1:
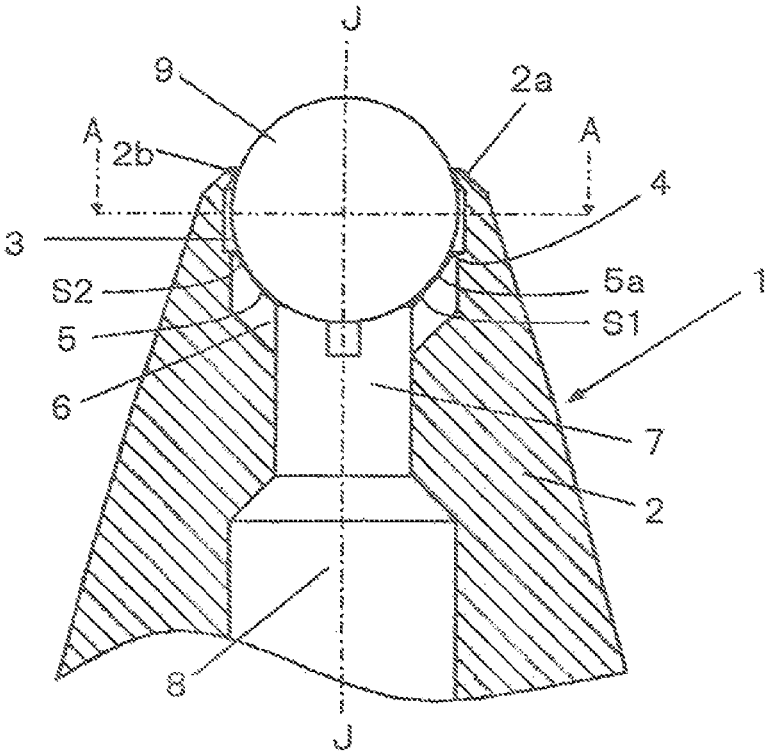
FIG. 1 is a longitudinal sectional view showing a ballpoint pen tip in a first embodiment.

A ballpoint pen tip 1 in a first embodiment shown in FIGS. 1 to 4 is the ballpoint pen tip 1 in which a tip end portion 2*a* of a tip body 2, which includes a ball holding chamber 3 configured to hold a ball 9, an ink circulation hole 7 formed in a center of a bottom wall 4 of the ball holding chamber 3, and a plurality of ink circulation grooves 6 (four ink circulation grooves in this example) extending radially from the ink circulation hole 7, is caulked inside, so that a part of the ball 9 held in the ball holding chamber 3 projects from a tip end edge and the ball 9 is rotatably held.

The tip body 2 is made of a stainless steel wire member. The ink circulation hole 7 is continuous to a tip rear hole 8. A diameter ϕ of the ball 9 is 0.5 mm. The ball 9 is made of tungsten carbide.

A feature of this embodiment resides in that a curved contact surface 5, which has a curvature different from a curvature of the ball 9, is provided on the bottom wall 4 of the ball holding chamber 3, and the ball 9 is in contact with a contact part which is a part of the contact surface 5.

Another feature of this embodiment resides in that, between the ball 9 and the contact surface 5, a first gap S1 is formed to extend from a side of the ink circulation hole 7 up to the contact part such that the first gap S1 gradually narrows from the side of the ink circulation hole 7, and a second gap S2 is formed to extend from a distal side of each ink circulation groove 6 up to the contact part such that the second gap S2 gradually narrows from the distal side of the ink circulation groove 6.

Such a ballpoint pen tip 1 is manufactured as described below. Namely, for example, a stainless steel wire member having a diameter ϕ of 2.3 mm and a hardness of from 230 Hv to 280 Hv is cut to have a desired length, and the ball holding chamber 3, the ink circulation hole 7 and the ink circulation grooves 6 extending radially from the ink circulation hole 7 are produced. Thereafter, a hammering operation is carried out from the side of the tip end portion 2*a* with the ball 9 being placed on the bottom wall 4 of the ball holding chamber 3, so that a curved surface, which has a radius of curvature larger than that of the ball 9, is formed by a spring-back property. Following thereto, the tip end portion 2*a* is caulked inside. Thus, the curved (in particular, mortar-like) contact surface 5, which has a curvature different from that of the ball 9, is formed, and the ball 9 is in contact with the contact part 5*a* on an annular line about a shaft center at a position nearer to the tip end portion 2*a* than a central position in a shaft center direction of the contact surface 5. Thus, the first gap S1 and the second gap S2 are formed between the ball 9 and the contact surface 5.

According to this embodiment, due to the formation of the first gap S1 and the second gap S2, it is easy to maintain a space between the ball 9 and the contact surface 5 (contact part 5*a*) in the fluid lubrication condition or in the mixed lubrication condition. Thus, wear of the contact surface (contact part) can be restrained.

Figure 2:
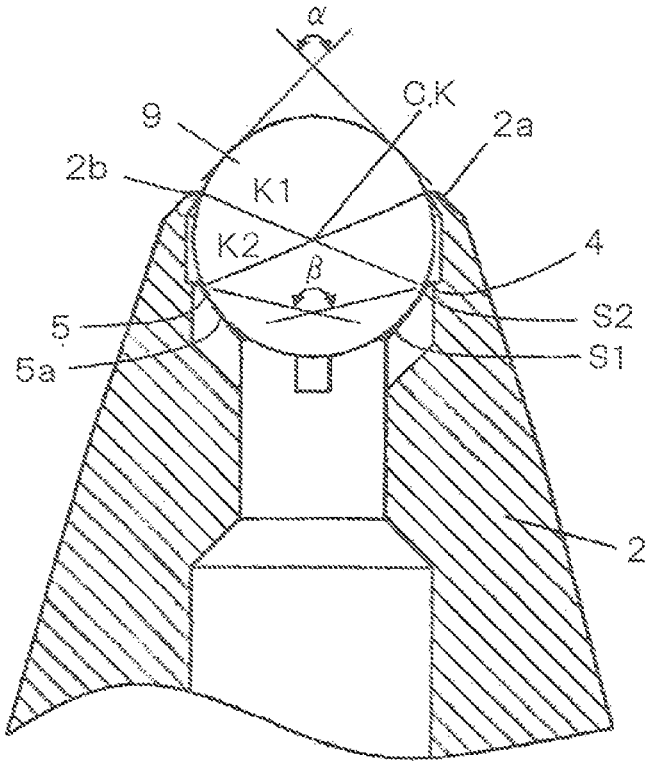
FIG. 2 is a view for explaining angles and so on in FIG. 1.
Figure 3:
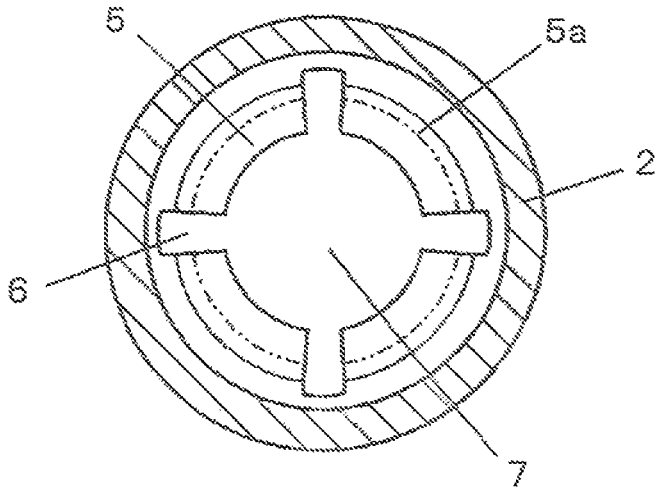
FIG. 3 is a sectional view of FIG. 1 taken along the arrows A-A.
Figure 4:
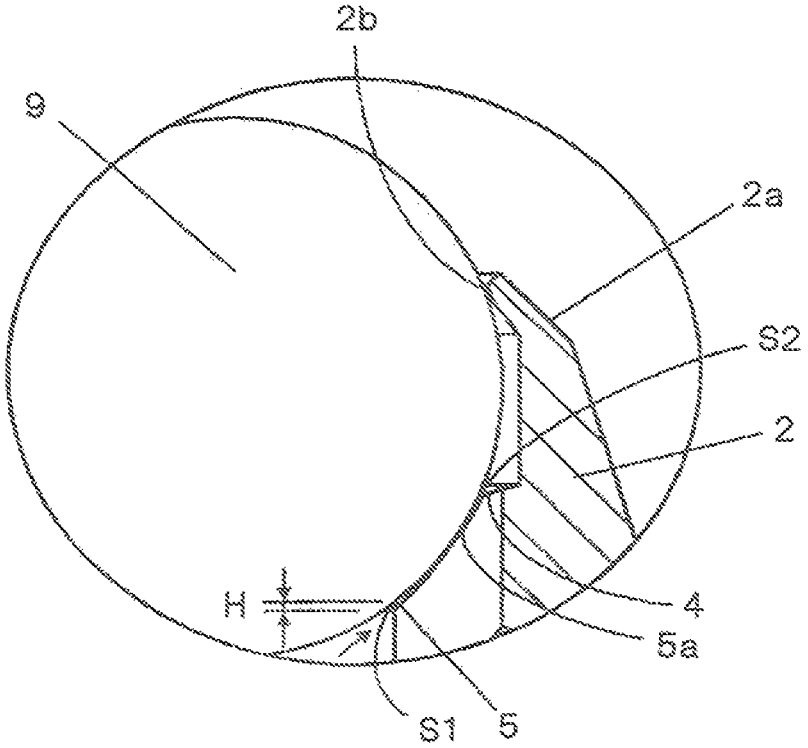
FIG. 4 is a longitudinal sectional view in enlargement showing a main part of the ballpoint pen tip in the first embodiment.

In this embodiment, a projecting length of the ball 9 projecting from the tip end edge is 20% of the ball diameter, a caulking angle α is 90 degrees, a longitudinal clearance (movable distance) of the ball 9 is 15 μm, and an inclination angle β of the bottom wall 4 is 135 degrees (see FIG. 2). Further, a length H of an opening of the first gap S1 on the side of the ink circulation hole 7 is 0.9 μm in the shaft center direction (see FIG. 4).

A curved seal surface 2*b* is formed on an inner wall of the tip end portion 2*a*. As shown in FIG. 2, an intersection point K of lines K1 and K2 each connecting an end edge of the contact surface 5 in the longitudinal sectional surface of FIG. 2 and an end edge of the seal surface 2*b* opposed to the contact surface 5 with respect to a shaft center 3 (see FIG. 1) passes a substantial center C of the ball. This restrains deviation of the ball 9, whereby the ball 9 is difficult to be disengaged from the contact surface 5. Thus, the following effects can be provided. Namely, the rotation of the ball 9 can be smoothened. It is easy to maintain constant the gap between the ball 9 and the seal surface 2*b*, so that a stable ink outflow rate can be achieved. In addition, an ink return is facilitated. Moreover, since the deviation of the ball 9 is restrained, uneven wear of the contact part 5*a* and the seal surface 2*b* by the rotation of the ball 9 can be restrained.

Second Embodiment

Figure 5:
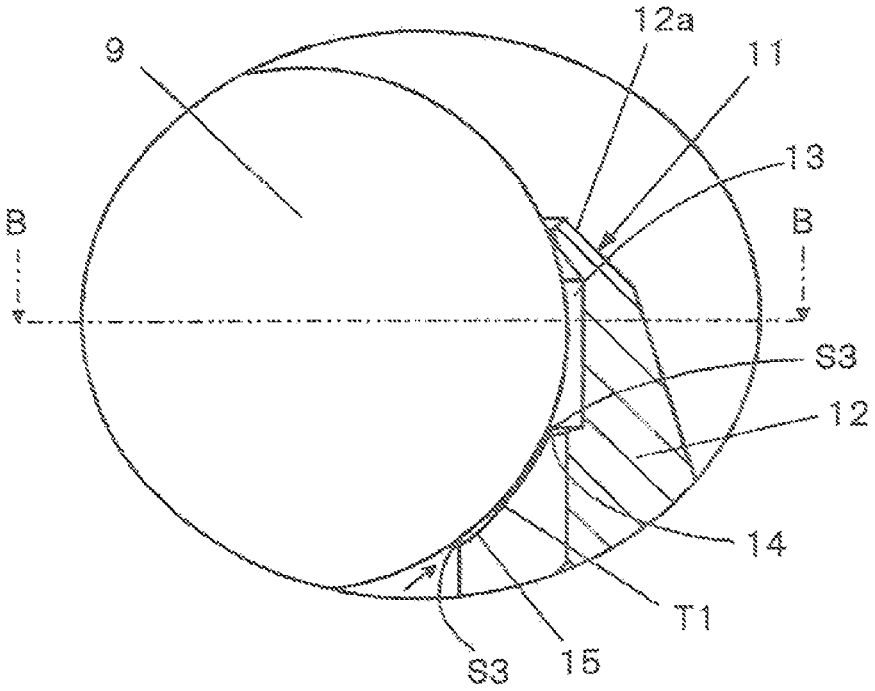
FIG. 5 is a longitudinal sectional view in enlargement showing a main part of a ballpoint pen tip in a second embodiment.
Figure 6:
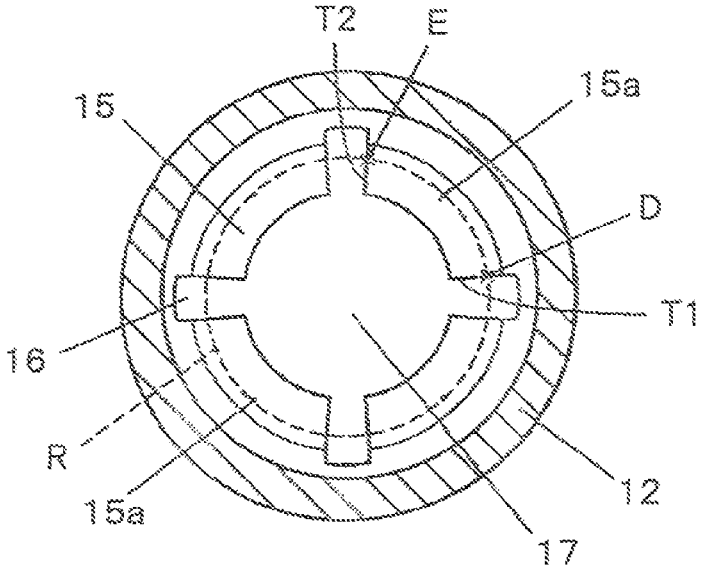
FIG. 6 is a sectional view of FIG. 5 taken along the arrows B-B.
Figure 7:
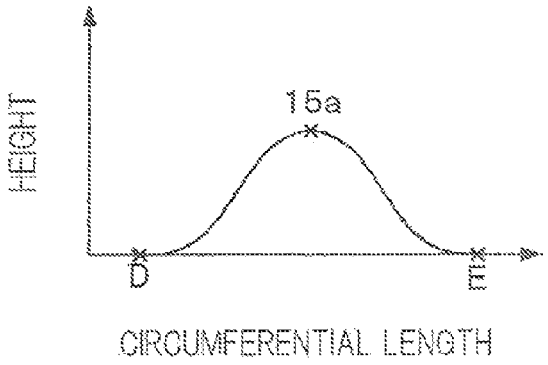
FIG. 7 is an explanatory view showing a condition of a contact surface in FIG. 5.

A ballpoint pen tip 11 in a second embodiment shown in FIGS. 5 to 7 is the ballpoint pen tip 11 in which a tip end portion 12*a* of a tip body 12, which includes a ball holding chamber 13 configured to hold a ball 9, an ink circulation hole 17 formed in a center of a bottom wall 14 of the ball holding chamber 13, and a plurality of ink circulation grooves 16 (four ink circulation grooves in this example) extending radially from the ink circulation hole 17, is caulked inside, so that a part of the ball 9 held in the ball holding chamber 13 projects from a tip end edge and the ball 9 is rotatably held.

The tip body 12 is also made of a stainless steel wire member. The ink circulation hole 17 is also continuous to a tip rear hole 18. A diameter ϕ of the ball 9 is 0.5 mm. The ball 9 is made of tungsten carbide.

Also in this embodiment, a curved contact surface 15, which has a curvature different from a curvature of the ball 9, is provided on the bottom wall 14 of the ball holding chamber 3. The ball 9 is in contact with a contact part which is a part of the contact surface 15.

A feature of this embodiment resides in that four substantially intermediate points of the contact surface 15 in a circumferential direction thereof between the ink circulation grooves 16 are formed to have a large height, so that the ball 9 is equally, substantially dottedly in contact with the contact surface 15 at the four points in the circumferential direction thereof. That is to say, the four points serve as the contact part(s) 15*a*.

To be specific, in the circumferential direction R, there are an intersection point D in a joint section T1 where a certain contact surface 15 and a certain ink circulation groove 16 are joined to each other, and an intersection point E in a joint section T2 where the certain contact surface 15 and another ink circulation groove 16 are joined to each other. A substantially intermediate (central) position between the intersection points D and E is the highest in the height of the contact surface 15. The ball 9 is in contact with the contact surface 15 at each contact part 15*a* that is substantially the top part.

Further, also in this embodiment, between the ball 9 and the contact surface 15, a first gap S1 is formed to extend from a side of the ink circulation hole 17 up to the contact part such that the first gap S1 gradually narrows from the side of the ink circulation hole 17, and a second gap S2 is formed to extend from a distal side of each ink circulation groove 16 up to the contact part such that the second gap S2 gradually narrows from the distal side of the ink circulation groove 16.

A feature of this embodiment resides in that a third gap S3 between the ball 9 and the contact surface 15 is exposed in the vicinity of each of the joint sections T1 and T2 where the contact surface 15 and the ink circulation grooves 16 are joined to each other.

Such a ballpoint pen tip 11 is manufactured as described below. Namely, for example, a stainless steel wire member having a diameter ϕ of 2.3 mm and a hardness of from 230 Hv to 280 Hv is cut to have a desired length, and the ball holding chamber 13, the ink circulation hole 17 and the ink circulation grooves 16 extending radially from the ink circulation hole 17 are produced. Thereafter, a hammering operation is carried out from the side of the tip end portion 12*a* with a hammering ball for molding, which differs from the ball 9, being placed on the bottom wall 14 of the ball holding chamber 13, so that a whole curved surface, which has a large radius of curvature in general and includes four raised points serving as the contact parts 15*a*, is formed by a spring-back property. Following thereto, the hammering ball is replaced with the regular ball 9, and the tip end portion 12*a* is caulked inside. Thus, the aforementioned contact surface 15 is formed, and the first gap S1, the second gap S2 and the third gap S3 are formed between the ball 9 and the contact surface 15.

According to this embodiment, due to the formation of the first gap S1, the second gap S2 and the third gap S3, it is easy to maintain a space between the ball 9 and the contact surface 15 (contact parts 15*a*) in the fluid lubrication condition or in the mixed lubrication condition. Thus, wear of the contact surface (contact parts) can be restrained.

In addition, according to this embodiment, the contact parts 15*a* are located apart from the ink circulation grooves 16. Thus, even when the contact parts 15*a* wear away, the wear exerts less influence on the function of the ink circulation grooves 16. Thus, a stable ink flow can be continuously maintained.

(Ballpoint Pen Refill Incorporating First Embodiment)

Figure 8:
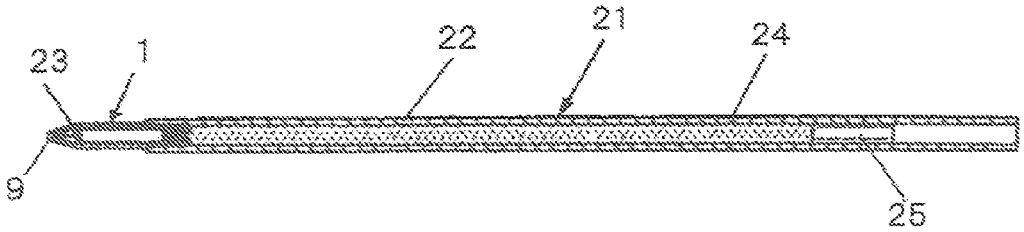
FIG. 8 is a view showing a ballpoint pen refill using the ballpoint pen tip in the first embodiment.
Figure 9:
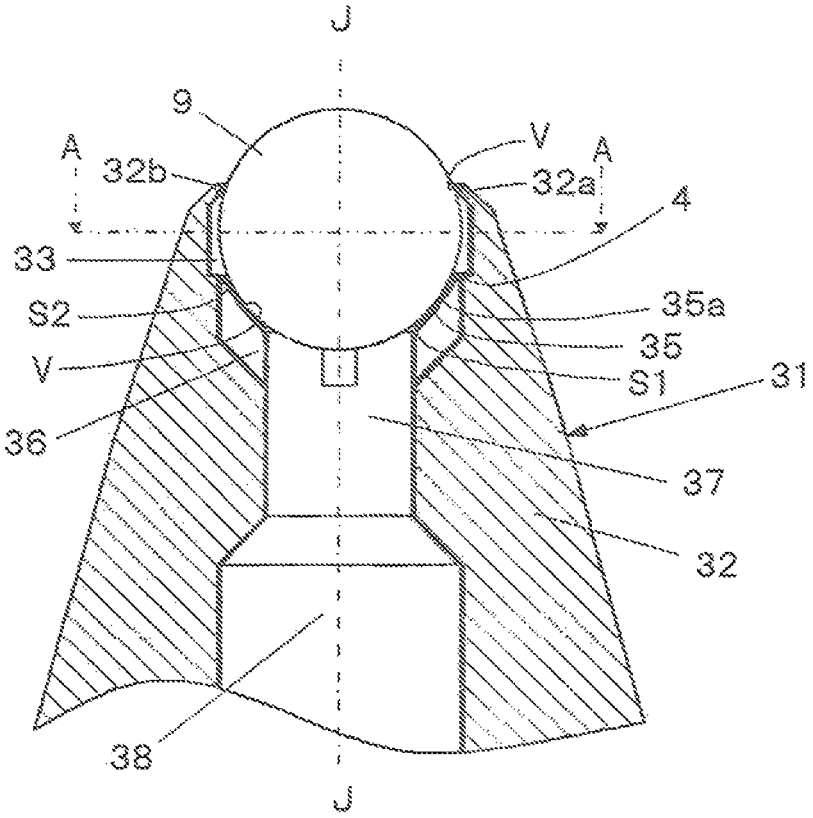
FIG. 9 is a longitudinal sectional view showing a ballpoint pen tip in a third embodiment.

FIG. 8 shows an example in which the ballpoint pen tip 1 in the first embodiment is incorporated in a ballpoint pen refill 21. Specifically, the ballpoint pen tip 1 in the first embodiment is mounted on an end portion of an ink storage tube 22. The ink storage tube 22 stores therein an oil-based ink for ballpoint pen 24 containing pigments having an average particle diameter of 0.5 μm, and a grease-like ink follower 25. The oil-based ink for ballpoint pen 24 has an ink viscosity of 2000 mPa·s (25° C.), which is measured by AR-G2 (stainless 40 $mm^{2°}$ rotor) manufactured by TA Instruments Japan Inc., at a temperature of 20° C. and at a shear rate of 500 $sec^{-1}$.

A coil spring 23 is disposed behind the ball 9. The ball 9 is pressed toward the seal surface 2*b* of the tip end portion 2*a* by a pressing force of the coil spring 23. The pressing force of the coil spring 23 pressing the ball 9 is 10 gf and a ball holding force is 450 gf.

When writing with the ballpoint pen refill 21 on a paper sheet, the ink for ballpoint pen 24 stored in the ink storage tube 22 is supplied to the ball 9 from the rear hole 8 of the ballpoint pen tip 1 through the ink circulation hole 7 and the ink circulation grooves 6. The ink for ballpoint pen 24 having been supplied to the ball 9 is discharged through a gap that is created between the inner wall of the tip end portion 2*a* and the ball 9 when the ball 9 is moved by a writing pressure toward the contact surface 5 at a distance corresponding to the clearance. Thus, writing can be done.

In addition, along with the rotation of the ball 9 when writing, the ink for ballpoint pen 24 is led from the ink circulation hole 7 into the first gap S1. Thus, a layer of the ink for ballpoint pen 24 is formed between the ball 9 and the contact surface 5. A pressure is generated by the ink layer, so that a force that floats up the ball 9 is generated (wedge effect). This restrains wear of the contact surface 5.

In addition, when writing, the ink for ballpoint pen 24 that could not protrude onto the paper sheet is returned from the ball holding chamber 3 to the contact surface 5. At this time, because of the formation of the second gap S2, another ink layer is also formed in the second gap S2. Thus, a feel of the ballpoint pen when writing and wear resistance can be improved by the synergy produced by the ink layer effect in the first gap S1 and the ink layer effect in the second gap S2.

The ink viscosity of the ink for ballpoint pen 24 is not particularly limited. However, when a viscosity when writing is smaller than 10 mPa·s, the ink viscosity is so low that there is a possibility that the fluid lubrication condition or the mixed lubrication condition between the ball and the contact surface is difficult to be provided. On the other hand, when the ink viscosity exceeds 5,000 mPa·s, a ball rotation resistance when writing is so large that a feel of the ballpoint pen when writing is likely to be heavy. Thus, the ink viscosity when writing is preferably from 10 to 5,000 mPa·s, more preferably from 30 to 3,000 mPa·s, and most preferably from 50 to 2,500 mPa·s.

In the first embodiment, after the spring-back property caused by hammering has been utilized, the bottom wall is inclined upon the caulking process so as to form the curved contact surface 5 having a radius of curvature larger than that of the ball 9 (a curvature smaller than that of the ball 9). However, as long as the curved contact surface 5 having the first gap S1 and the second gap S2 can be obtained, the method of forming the contact surface 5 is not particularly limited.

In addition, the caulking angle α of the ballpoint pen tip 1, the ball diameter, the ball projecting length and so on are not particularly limited. However, when the angle β of the bottom wall 4 is smaller than 90 degrees, it is difficult to form the second gap S2 on the contact surface 5. Meanwhile, when the angle β of the bottom wall 4 exceeds 150 degrees, it is difficult to form the first gap S1. Thus, the angle β of the bottom wall 4 is preferably not less than 90 degrees and not more than 150 degrees, and most preferably from 100 degrees to 140 degrees.

Third Embodiment

A ballpoint pen tip 31 in a third embodiment shown in FIGS. 9 to 12 is the ballpoint pen tip 31 in which a tip end portion 32*a* of a tip body 32, which includes a ball holding chamber 33 configured to hold a ball 9, an ink circulation hole 37 formed in a center of a bottom wall 34 of the ball holding chamber 33, and a plurality of ink circulation grooves 36 (four ink circulation grooves in this example) extending radially from the ink circulation hole 37, is caulked inside, so that a part of the ball 9 held in the ball holding chamber 33 projects from a tip end edge and the ball 9 is rotatably held.

The tip body 32 is made of a stainless steel wire member. The ink circulation hole 37 is continuous to a tip rear hole 38. A diameter ϕ of the ball 9 is 0.5 mm. The ball 9 is made of tungsten carbide.

Also in this embodiment, a curved contact surface 35, which has a curvature different from a curvature of the ball 9, is provided on the bottom wall 34 of the ball holding chamber 33. The ball 9 is in contact with a contact part 35*a* which is a part of the contact surface 35.

Further, between the ball 9 and the contact surface 35, a first gap S1 is formed to extend from a side of the ink circulation hole 37 up to the contact part 35*a* such that the first gap S1 gradually narrows from the side of the ink circulation hole 37, and a second gap S2 is formed to extend from a distal side of each ink circulation groove 36 up to the contact part such that the second gap S2 gradually narrows from the distal side of the ink circulation groove 36.

A feature of this embodiment resides in that a face of the contact surface 35 is provided with a lubrication coating layer V made of a surface layer part of diamond-like carbon (DLC). In addition, a seal surface 32*b* described hereafter is also provided with a lubrication coating layer V made of a surface layer part of diamond-like carbon (DLC).

Such a ballpoint pen tip 31 is manufactured as described below. Namely, for example, a stainless steel wire member having a diameter ϕ of 2.3 mm and a hardness of from 230 Hv to 280 Hv is cut to have a desired length, and the ball holding chamber 33, the ink circulation hole 37 and the ink circulation grooves 36 extending radially from the ink circulation hole 37 are produced. Thereafter, an area on a side where the ball 9 is placed, i.e., at least a part to be formed as the contact surface 35 and a part to be formed as the seal surface 32*b* are provided with the lubrication coating layers V made of a surface layer part of diamond-like carbon (DLC). Then, a hammering operation is carried out from the side of the tip end portion 32*a* with the ball 9 being placed on the bottom wall 34 of the ball holding chamber 33, so that a curved surface, which has a radius of curvature larger than that of the ball 9, is formed by a spring-back property. Following thereto, the tip end portion 32*a* is caulked inside. Thus, the curved contact surface 35, which has a curvature different from that of the ball 9, is formed, and the ball 9 is in contact with the contact part 35*a* on an annular line about a shaft center at a position nearer to the tip end portion 32*a* than a central position in a shaft center direction of the contact surface 35. Thus, the first gap S1 and the second gap S2 are formed between the ball 9 and the contact surface 35.

According to this embodiment, due to the formation of the first gap S1 and the second gap S2, it is easy to maintain a space between the ball 9 and the contact surface 35 (contact part 35*a*) in the fluid lubrication condition or in the mixed lubrication condition. Thus, wear of the contact surface (contact part) can be restrained. In addition, in this embodiment, since the lubrication coating layers V made of a surface layer part of diamond-like carbon (DLC) are provided on the face of the contact surface 35 and the seal surface 32*b*, the wear restraining effect can be further improved.

Figure 10:
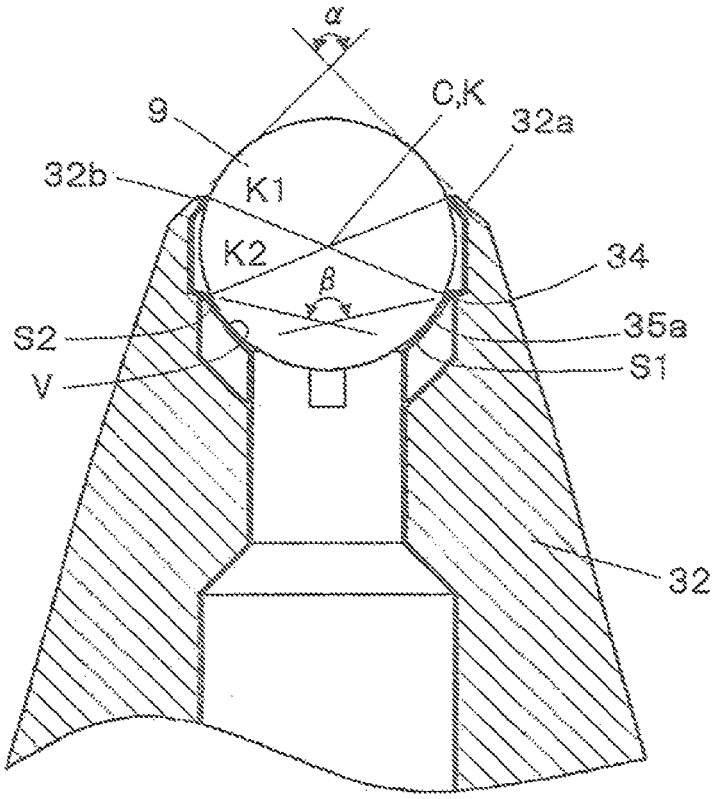
FIG. 10 is a view for explaining angles and so on in FIG. 9.
Figure 11:
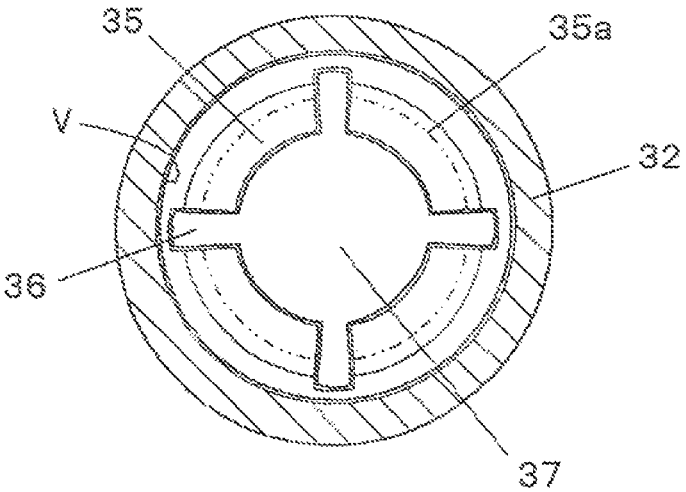
FIG. 11 is a sectional view of FIG. 9 taken along the arrows A-A.
Figure 12:
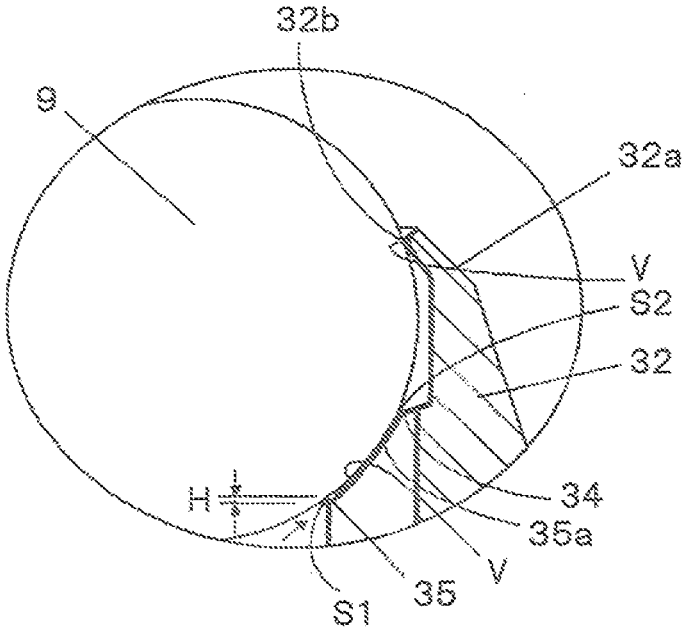
FIG. 12 is a longitudinal sectional view in enlargement showing a main part of a ballpoint pen tip in a fourth embodiment.

In this embodiment, a projecting length of the ball 9 projecting from the tip end edge is 20% of the ball diameter, a caulking angle α is 90 degrees, a longitudinal clearance (movable distance) of the ball 9 is 15 μm, and an inclination angle β of the bottom wall 34 is 135 degrees (see FIG. 10). Further, a length H of an opening of the first gap S1 on the side of the ink circulation hole 37 is 0.9 μm in the shaft center direction (see FIG. 12).

The curved seal surface 32*b* is formed on an inner wall of the tip end portion 32*a*. As shown in FIG. 10, an intersection point K of lines K1 and K2 each connecting an end edge of the contact surface 35 in the longitudinal sectional surface of FIG. 10 and an end edge of the seal surface 32*b* opposed to the contact surface 35 with respect to a shaft center 3 (see FIG. 9) passes a substantial center C of the ball. This restrains deviation of the ball 9, whereby the ball 9 is difficult to be disengaged from the contact surface 35. Thus, the following effects can be provided. Namely, the rotation of the ball 9 can be smoothened. It is easy to maintain constant the gap between the ball 9 and the seal surface 32*b*, so that a stable ink outflow rate can be achieved. In addition, an ink return is facilitated. Moreover, since the deviation of the ball 9 is restrained, uneven wear of the contact part 35*a* and the seal surface 32*b* by the rotation of the ball 9 can be restrained.

Fourth Embodiment

Figure 13:
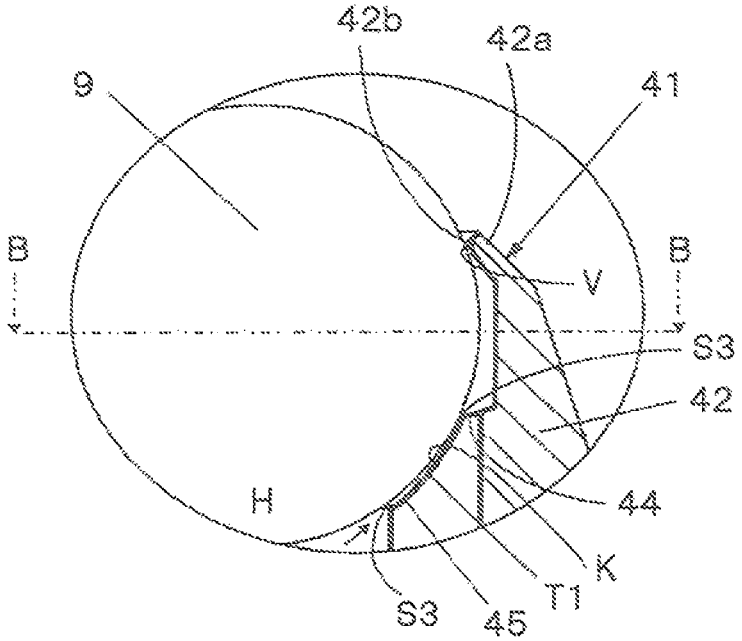
FIG. 13 is an explanatory view showing a contact surface in FIG. 12.
Figure 14:
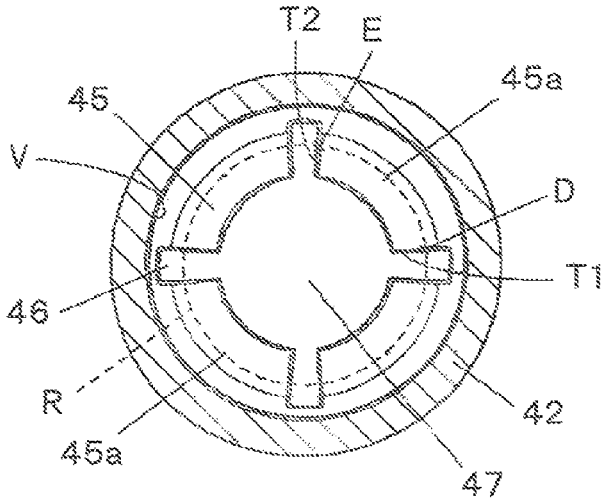
FIG. 14 is a sectional view of FIG. 13 taken along the arrows B-B.
Figure 15:
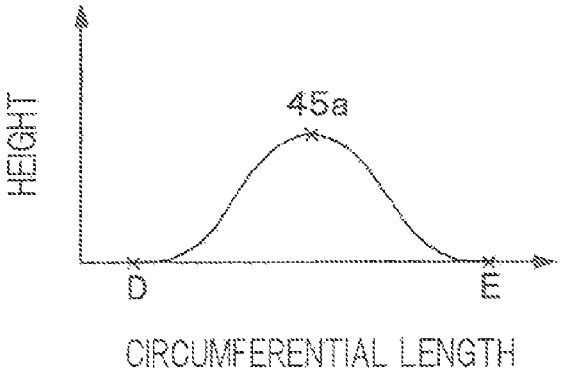
FIG. 15 is an explanatory view showing a condition of a contact surface in FIG. 13.

A ballpoint pen tip 41 in a fourth embodiment shown in FIGS. 13 to 15 is the ballpoint pen tip 41 in which a tip end portion 42*a* of a tip body 42, which includes a ball holding chamber 43 configured to hold a ball 9, an ink circulation hole 47 formed in a center of a bottom wall 44 of the ball holding chamber 43, and a plurality of ink circulation grooves 46 (four ink circulation grooves in this example) extending radially from the ink circulation hole 47, is caulked inside, so that a part of the ball 9 held in the ball holding chamber 43 projects from a tip end edge and the ball 9 is rotatably held.

The tip body 42 is also made of a stainless steel wire member. The ink circulation hole 47 is also continuous to a tip rear hole 48. A diameter ϕ of the ball 9 is 0.5 mm. The ball 9 is made of tungsten carbide.

Also in this embodiment, a curved contact surface 45, which has a curvature different from a curvature of the ball 9, is provided on the bottom wall 44 of the ball holding chamber 43. The ball 9 is in contact with a contact part which is a part of the contact surface 45.

A feature of this embodiment resides in that four substantially intermediate points of the contact surface 45 in a circumferential direction thereof between the ink circulation grooves 46 are formed to have a large height, so that the ball 9 is equally, substantially dottedly in contact with the contact surface 45 at the four points in the circumferential direction thereof. That is to say, the four points serve as the contact part(s) 45*a*.

To be specific, in the circumferential direction R, there are an intersection point D in a joint section T1 where a certain contact surface 45 and a certain ink circulation groove 46 are joined to each other, and an intersection point E in a joint section T2 where the certain contact surface 45 and another ink circulation groove 46 are joined to each other. A substantially intermediate (central) position between the intersection points D and E is the highest in the height of the contact surface 45. The ball 9 is in contact with the contact surface 45 at each contact part 45*a* that is substantially the top part.

Further, also in this embodiment, between the ball 9 and the contact surface 45, a first gap S1 is formed to extend from a side of the ink circulation hole 47 up to the contact part such that the first gap S1 gradually narrows from the side of the ink circulation hole 47, and a second gap S2 is formed to extend from a distal side of each ink circulation groove 46 up to the contact part such that the second gap S2 gradually narrows from the distal side of the ink circulation groove 46.

A feature of this embodiment resides in that a third gap S3 between the ball 9 and the contact surface 45 is exposed in the vicinity of each of the joint sections T1 and T2 where the contact surface 45 and the ink circulation grooves 46 are joined to each other.

Such a ballpoint pen tip 41 is manufactured as described below. Namely, for example, a stainless steel wire member having a diameter ϕ of 2.3 mm and a hardness of from 230 Hv to 280 Hv is cut to have a desired length, and the ball holding chamber 43, the ink circulation hole 47 and the ink circulation grooves 46 extending radially from the ink circulation hole 47 are produced. Thereafter, a hammering operation is carried out from the side of the tip end portion 42*a* with a hammering ball for molding, which differs from the ball 9, being placed on the bottom wall 44 of the ball holding chamber 43, so that a whole curved surface, which has a large radius of curvature in general and includes four raised points serving as the contact parts 45*a*, is formed by a spring-back property. Following thereto, the hammering ball is replaced with the regular ball 9, and the tip end portion 42*a* is caulked inside. Thus, the aforementioned contact surface 45 is formed, and the first gap S1, the second gap S2 and the third gap S3 are formed between the ball 9 and the contact surface 45.

Also according to this embodiment, due to the formation of the first gap S1, the second gap S2 and the third gap S3, it is easy to maintain a space between the ball 9 and the contact surface 45 (contact parts 45*a*) in the fluid lubrication condition or in the mixed lubrication condition. Thus, wear of the contact surface (contact parts) can be restrained. In addition, in this embodiment, since the lubrication coating layers V made of a surface layer part of diamond-like carbon (DLC) are provided on the face of the contact surface 45 and the seal surface 42*b*, the wear restraining effect can be further improved.

In addition, according to this embodiment, the contact parts 45*a* are located apart from the ink circulation grooves 46. Thus, even when the contact parts 45*a* wear away, the wear exerts less influence on the function of the ink circulation grooves 46. Thus, a stable ink flow can be continuously maintained.

(Ballpoint Pen Refill Incorporating Third Embodiment)

Figure 16:
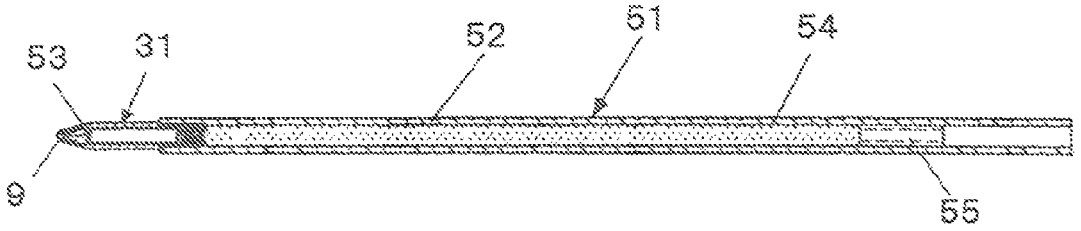
FIG. 16 is a view showing a ballpoint pen refill using the ballpoint pen tip in the third embodiment.

FIG. 16 shows an example in which the ballpoint pen tip 31 in the third embodiment is incorporated in a ballpoint pen refill 51. Specifically, the ballpoint pen tip 31 in the third embodiment is mounted on an end portion of an ink storage tube 52. The ink storage tube 52 stores therein an oil-based ink for ballpoint pen 54 containing pigments having an average particle diameter of 0.5 μm, and a grease-like ink follower 55. The oil-based ink for ballpoint pen 54 has an ink viscosity of 2000 mPa·s (25° C.), which is measured by AR-G2 (stainless 40 mm$^{2°}$ rotor) manufactured by TA Instruments Japan Inc., at a temperature of 20° C. and at a shear rate of 500 sec$^{-1}$.

A coil spring 53 is disposed behind the ball 9. The ball 9 is pressed toward the seal surface 32*b* of the tip end portion 32*a* by a pressing force of the coil spring 53. The pressing force of the coil spring 53 pressing the ball 9 is 10 gf and a ball holding force is 450 gf.

When writing with the ballpoint pen refill 51 on a paper sheet, the ink for ballpoint pen 54 stored in the ink storage tube 52 is supplied to the ball 9 from the rear hole 38 of the ballpoint pen tip 31 through the ink circulation hole 37 and the ink circulation grooves 36. The ink for ballpoint pen 54 having been supplied to the ball 9 is discharged through a gap that is created between the inner wall of the tip end portion 32*a* and the ball 9 when the ball 9 is moved by a writing pressure toward the contact surface 35 at a distance corresponding to the clearance. Thus, writing can be done.

In addition, along with the rotation of the ball 9 when writing, the ink for ballpoint pen 54 is led from the ink circulation hole 37 into the first gap S1. Thus, a layer of the ink for ballpoint pen 54 is formed between the ball 9 and the contact surface 35. A pressure is generated by the ink layer, so that a force that floats up the ball 9 is generated (wedge effect). This restrains wear of the bottom wall 34.

In addition, when writing, the ink for ballpoint pen 54 that could not protrude onto the paper sheet is returned from the ball holding chamber 33 to the contact surface 35. At this time, because of the formation of the second gap S2, another ink layer is also formed in the second gap S2. Thus, a feel of the ballpoint pen when writing and wear resistance can be improved by the synergy produced by the ink layer effect in the first gap S1 and the ink layer effect in the second gap S2.

The ink viscosity of the ink for ballpoint pen 54 is not particularly limited. However, when a viscosity when writing is smaller than 10 mPa·s, the ink viscosity is so low that there is a possibility that the fluid lubrication condition or the mixed lubrication condition between the ball and the contact surface is difficult to be provided. On the other hand, when the ink viscosity exceeds 5,000 mPa·s, a ball rotation resistance when writing is so large that a feel of the ballpoint pen when writing is likely to be heavy. Thus, the ink viscosity when writing is preferably from 10 to 5,000 mPa·s, more preferably from 30 to 3,000 mPa·s, and most preferably from 50 to 2,500 mPa·s.

In the third embodiment, after the spring-back property caused by hammering has been utilized, the caulking process is carried out so as to form the curved contact surface 35 having a radius of curvature larger than that of the ball 9 (a curvature smaller than that of the ball 9). However, as long as the curved contact surface 35 having the first gap S1 and the second gap S2 can be obtained, the method of forming the contact surface 35 is not particularly limited.

In addition, the caulking angle α of the ballpoint pen tip 31, the ball diameter, the ball projecting length and so on are not particularly limited. However, when the angle β of the bottom wall 34 is smaller than 90 degrees, it is difficult to form the second gap S2 on the contact surface 35. Meanwhile, when the angle β of the bottom wall 34 exceeds 150 degrees, it is difficult to form the first gap S1. Thus, the angle β of the bottom wall 34 is preferably not less than 90 degrees and not more than 150 degrees, and most preferably from 100 degrees to 140 degrees.

What is claimed is:

1. A ballpoint pen tip in which a tip end portion of a tip body, which includes a ball holding chamber configured to hold a ball, an ink circulation hole formed in a center of a bottom wall of the ball holding chamber, and a plurality of ink circulation grooves extending radially from the ink circulation hole, is caulked inside, so that a part of the ball held in the ball holding chamber projects from a tip end edge and the ball is rotatably held, wherein:

a curved contact surface, in which the ball is inscribed, which has a curvature different from a curvature of the ball, is provided on the bottom wall of the ball holding chamber, and the ball is to be in contact with a contact part which is a part of the contact surface;

between the ball and the contact surface, a first gap is formed to extend from a side of the ink circulation hole up to the contact part such that the first gap gradually narrows from the side of the ink circulation hole, and a second gap is formed to extend from a distal side of an ink circulation groove up to the contact part such that the second gap gradually narrows from the distal side of the ink circulation groove; and a length of an opening of the first gap on the side of the ink circulation hole is from 0.001 μm to less than 10 μm in the shaft center direction.

2. The ballpoint pen tip according to claim 1, wherein the contact part is located nearer to the tip end portion than a central position in a shaft center direction of the contact surface.

3. The ballpoint pen tip according to claim 1, wherein the contact surface is axisymmetric with respect to a shaft center, and the contact part is located annularly in a circumferential direction of the contact surface.

4. The ballpoint pen tip according to claim 1, wherein the contact part is located at substantially regular intervals in a circumferential direction of the contact surface.

5. A ballpoint pen refill in which the ballpoint pen tip according to claim 1 is mounted directly on an end of an ink storage tube or mounted thereon through a tip holder, the ink storage tube storing an ink for ballpoint pen, wherein the ink for ballpoint pen contains at least particles, and a size of the particles is smaller than the length of the opening on the side of the ink circulation hole in the shaft center direction.

6. The ballpoint pen tip according to claim 1, wherein a face of the ball and/or a face of the contact surface is provided with a lubrication coating layer.

7. The ballpoint pen tip according to claim 6, wherein the contact part is located nearer to the tip end portion than a central position in a shaft center direction of the contact surface.

8. The ballpoint pen tip according to claim 6, wherein the contact surface is axisymmetric with respect to a shaft center, and the contact part is located annularly in a circumferential direction of the contact surface.

9. The ballpoint pen tip according to claim 6, wherein the contact part is located at substantially regular intervals in a circumferential direction of the contact surface.

10. A ballpoint pen refill in which the ballpoint pen tip according to claim 6 is mounted directly on an end of an ink storage tube or mounted thereon through a tip holder, the ink storage tube storing an ink for ballpoint pen, wherein the ink for ballpoint pen contains at least particles, and a size of the particles is smaller than the length of the opening on the side of the ink circulation hole in the shaft center direction.

* * * * *